United States Patent [19]

Badtke et al.

[11] 4,342,403

[45] Aug. 3, 1982

[54] BOX AND LID CONSTRUCTION

[75] Inventors: Deane L. Badtke; Robert V. Lehman, both of Rockford, Ill.

[73] Assignee: Keystone Consolidated Industries, Inc., Peoria, Ill.

[21] Appl. No.: 243,058

[22] Filed: Mar. 12, 1981

Related U.S. Application Data

[63] Continuation of Ser. No. 91,544, Nov. 5, 1979, abandoned, which is a continuation of Ser. No. 923,894, Jul. 12, 1978, abandoned, which is a continuation of Ser. No. 786,476, Apr. 11, 1977, abandoned.

[51] Int. Cl.[3] ..... B65D 83/04

[52] U.S. Cl. ..... 220/345; 220/306; 220/350; 206/540; 206/602

[58] Field of Search ..... 220/306, 345, 350, 351; 206/1.5, 540, 806; 229/9

[56] References Cited

U.S. PATENT DOCUMENTS

| | | | |
|---|---|---|---|
| 2,563,865 | 8/1951 | Pottle | 220/345 X |
| 3,082,902 | 3/1963 | Kimbrough, Jr. | 220/345 X |
| 3,126,444 | 3/1964 | Taylor | 220/306 X |
| 3,171,565 | 3/1965 | Nozette | 220/306 X |
| 3,756,387 | 9/1973 | Chaney | 220/345 X |
| 3,833,143 | 9/1974 | Starkermann et al. | 220/345 |
| 3,888,350 | 6/1975 | Horvath | 220/350 X |
| 4,072,232 | 2/1978 | Marsman et al. | 206/602 |
| 4,113,098 | 9/1978 | Howard | 206/540 |

*Primary Examiner*—Steven M. Pollard

*Attorney, Agent, or Firm*—Allegretti, Newitt, Witcoff & McAndrews, Ltd.

[57] ABSTRACT

An improved container and lid construction includes a rectangular box of molded plastic with one pair of opposed sides of the box having a shaped lip member that cooperates with a compatible shaped flange member of the lid. The lid is fabricated from an extruded plastic material and designed to snap on the top of the box in an automatic filling operation. The lid may then be slidably removed from the box.

1 Claim, 5 Drawing Figures

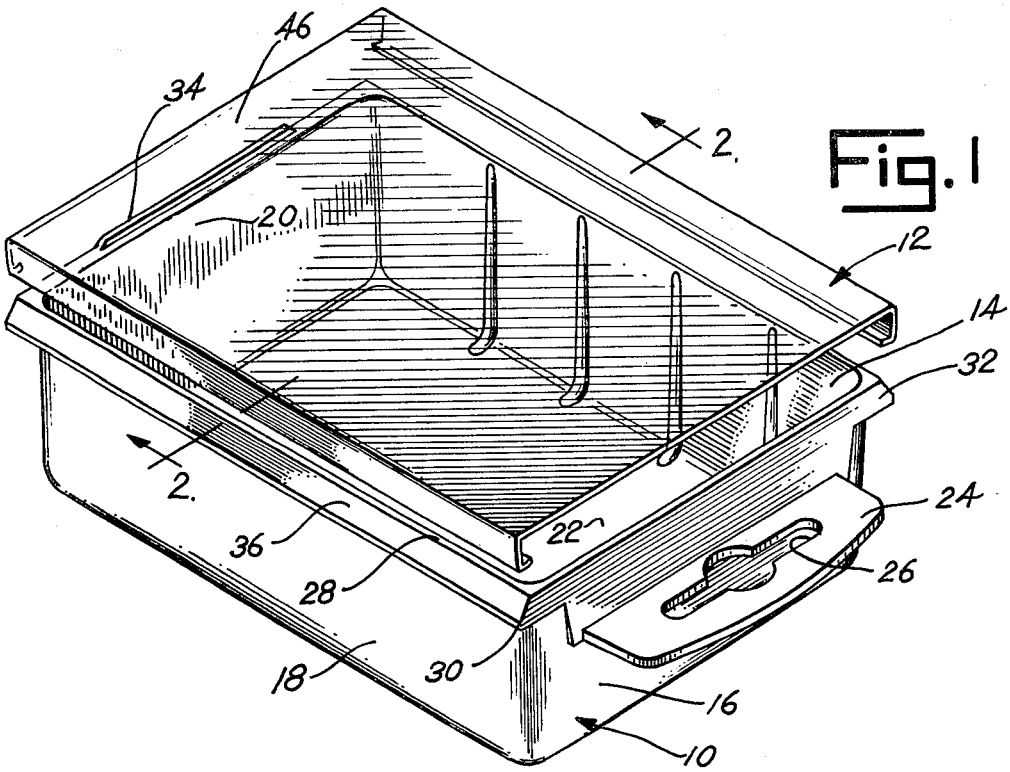
Fig. 1
Fig. 2
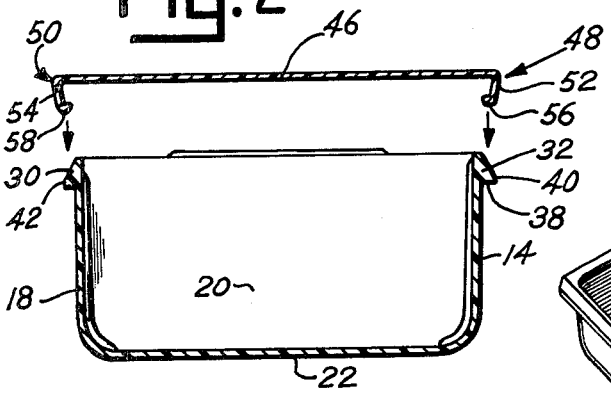
Fig. 3
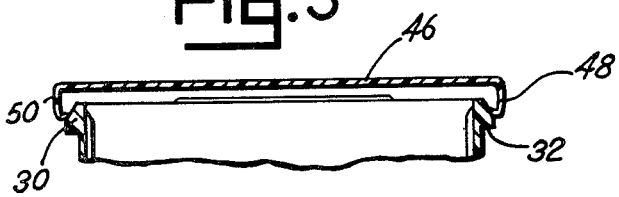
Fig. 4
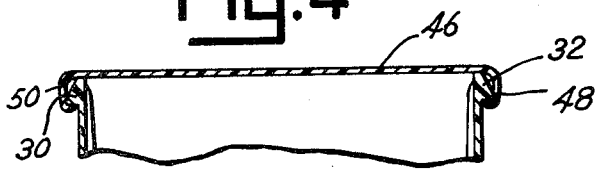
Fig. 5
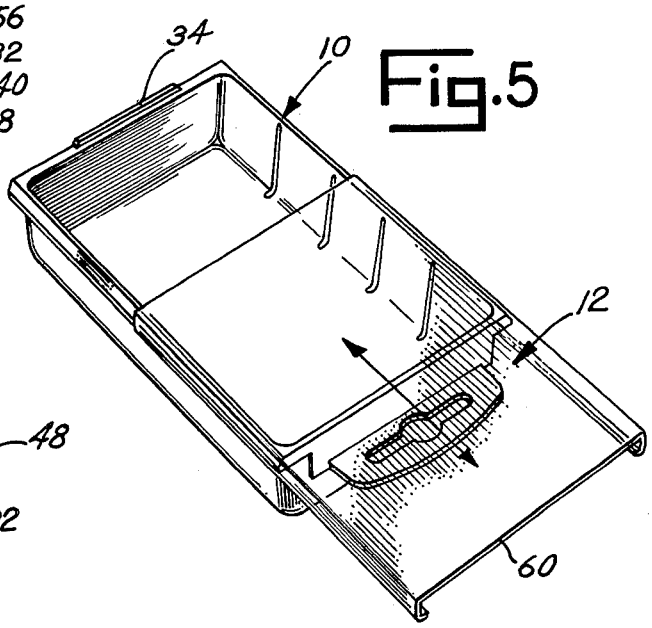

BOX AND LID CONSTRUCTION

This is a continuation of application Ser. No. 91,544, filed Nov. 5, 1979, now abandoned; which is a continuation of Ser. No. 923,894, filed July 12, 1978, now abandoned, which is a continuation of Ser. No. 786,476, filed Apr. 11, 1977, now abandoned.

BACKGROUND OF THE INVENTION

The invention relates to an improved container construction and more particularly to a four-sided plastic box and lid particularly useful in automatic packaging operations.

When packaging small hardware items for sale particularly at consumer outlets, it is desirable to utilize packages which may be conveniently suspended from display racks. Additionally, the packages may include a window so that the contents of the package are viewable by the potential customer. Another feature desired in such packages is compatibility with automatic filling equipment. Thus, a container may be automatically filled with materials at one station and moved to a distinct station where a lid for the container is positioned and attached to the container.

Various prior art packaging items and equipment have been suggested to accomplish the desired objectives. The present invention constitutes an improvement over such prior art.

SUMMARY OF THE INVENTION

In a principal aspect, the present invention comprises a container including a four-sided box with a lid attached by snap action. The box is rectangular in shape. One pair of opposed sides of the rectangular box includes a special lip member cooperative with spaced flanges on the lid. This construction enables the lid to snap onto the box. Removal of the lid from the box is effected by sliding the lid relative to the box along the flanges. An abutment projection at one end of the box prevents sliding of the lid beyond a desired position.

It is thus an object of the present invention to provide an improved container construction.

A further object of the present invention is to provide a container construction including a box and a lid compatible with the box, the lid being attached to the box by snap action.

Still a further object of the present invention is to provide a box and lid construction which is easy to assemble subsequent to filling the box with material.

One further object of the present invention is to provide a box and lid which are easily fabricated, inexpensive and easy to assemble and disassemble.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is an exploded perspective view of the improved container construction of the present invention;

FIG. 2 is a cross-sectional view of the lid and box forming the container of the invention taken substantially along the line 2—2 in FIG. 1;

FIG. 3 is a partial cross-sectional view of the lid and box similar to FIG. 2;

FIG. 4 is a cross-sectional view similar to FIG. 3 wherein the lid has been positioned on the box; and FIG. 5 is a perspective view illustrating the manner in which the lid is removed from the box.

DESCRIPTION OF THE PREFERRED EMBODIMENT

Referring to the figures, a product package is formed by the combination of a container 10 with a lid 12. The container 10 is preferably fabricated from a molded plastic material and includes four sides 14, 16, 18 and 20 all connected with a bottom 22. The sides 14, 16, 18 and 20 define a rectangular container 10 with opposed sides 14 and 18; 16 and 20. Integrally molded at one side 16 of the container is a support bracket 24. Support bracket 24 projects substantially transverse to side 16 and includes a slot 26 designed to cooperate with a hook of a display rack.

Circumscribing the top of the container 10 is a continuous planar top surface 28. Top surface 28 defines a portion of opposed lip members 30 and 32 associated with sides 14 and 18, respectively. Sides 16 and 20 do not include a special lip member. The top surface 28 includes a stop projection 34 projecting out of the top surface 28 at side 20.

The structure of the lip members 30 and 32 is quite important. FIGS. 2–4 illustrate in cross section this structure. Each lip member, in addition to the planar top surface 28, includes a downwardly and outwardly extending inclined surface 36. A lower lip surface 38 transverse to the side walls 14 and 18 intersects with the inclined surface 36 to define an edge 40 for wall 14 and a spaced parallel edge 42 associated with wall 18. The significance of the spacing of edges 40 and 42 as well as surfaces 28 and 38 will become more apparent upon the description of the lid 12.

The lid 12 is a generally rectangular structure extruded from clear plastic material. The lid includes a planar top 46 which covers the opening defined by sides 14, 16, 18 and 20. Side flanges 48 and 50 extend transverse to the top surface 46. Side flange 48 cooperates with lip member 32. Side flange 50 cooperates with lip member 30. In the embodiment shown, the side flanges 48, 50 are comprised of side surface sections 52 and 54, respectively, which extend from the top section 46 at a slight inward, acute angle relative thereto. In other words, side surface sections 52 and 54 are inclined toward each other. The side surface sections 52 and 54 respectively terminate with lower gripping portions 56 and 58, respectively, which are generally parallel to the top section 46. The lower gripping portions 56 and 58, respectively, are spaced from the top section 46 a distance equal to or just slightly greater than the spacing between planar top surface 28 and lower lip surface 38. The side surface sections 52 and 54 are spaced from each other a distance equal to the distance between edges 40 and 42.

The structure of the invention lends itself to an automatic filling operation. That is, the container 10 may be filled. The lid 12 may then be projected downwardly as shown in FIG. 2 over the top of the container 10. As the lid 12 is projected downwardly, the lower gripping portions 56 and 58 engage the inclined surface 36 as shown in FIG. 3. Because the lid 12 is flexible, the side flanges ride over the lip members and snap into a locking position as shown in FIG. 4 upon subsequent movement of the lid 12 in the continued downward position illustrated by FIG. 4.

As shown in FIG. 5, the lid 12 may then be removed by sliding action in the direction shown by the arrow in FIG. 5. The stop projection 34 prevents sliding of the lid 12 beyond the end of the container 10 defined by side 20. A paper label may be attached over the end 60 of lid 12 and the side 16 to hold the lid 12 in a sealed locked position. The paper may then be torn or the seal broken in order to permit the sliding of the lid 12 on the container 10 as shown in FIG. 5.

With the product of the present invention, it is possible to provide an attractive and utilitarian container for packaging hardware items such as screws, nails and the like. Packing of the container is facilitated by the snap action of the lid onto the container. Removal of the lid from the container is also quite easy. Finally, the product lends itself to display since the lid 12 may be preferably made from a clear plastic material for viewing the contents within the container 10. Therefore, while in the foregoing there has been set forth a preferred embodiment of the invention, it is to be understood that the invention shall be limited only by the following claims and their equivalents.

What is claimed is:

1. A container and lid comprising in combination:

a container in the form of a rectangular box with four sides, a bottom and an open top side, each one of a first pair of opposed sides including a lip member, extending along the entire side, each lip member including a planar top surface, each lip member also including a downwardly and outwardly slanted inclined surface defining a cam surface terminating at an edge and also including a lower lip surface, the edges of each of the lip members being spaced substantially uniformly, the top surface and lower lip surface being spaced substantially uniformly, the other pair of opposed sides including a planar top surface coplanar with the planar top surface of the first pair of sides, one of the other pair of sides also including a stop projection extension from the top surface and side opposite the one of the other pair of sides including an integral support bracket projecting substantially transverse to the side opposite and including a slot for cooperation with a hook; and a substantially flat, four-sided lid of flexible material having a top which covers the open top side of the container by resting on the coplanar top surfaces and also having two opposed depending opposite side flanges extending along the entire side, each flange including a side surface section depending substantially transverse to the top and spaced therefrom, the side surface sections being spaced substantially equal to the distance said edges are spaced and said lower gripping portion being spaced from the top of the lid substantially equal to the distance of the lower lip surface from the top surface, and providing means whereby the lid may be positioned on the box by impressing the lid flanges downwardly on the box edges and flexing the lid to snap the lid flanges over the lip members and further providing means whereby the lid may be removed from the box only by sliding the lid away from the stop projection in the top portion toward the support bracket, said stop projection acting to limit sliding movement of the lid in one direction and prevent accidental removal of the lid from the container when hanging on a hook by downward sliding of the lid.

* * * * *